US005347934A

United States Patent [19]

Dunnett

[11] Patent Number: 5,347,934

[45] Date of Patent: Sep. 20, 1994

[54] SLEEPER LAYING APPARATUS

[75] Inventor: Graeme S. Dunnett, Balgownie, Australia

[73] Assignee: Macbon Pty. Ltd., Australia

[21] Appl. No.: 74,128

[22] Filed: Jun. 8, 1993

[30] Foreign Application Priority Data

Dec. 22, 1992 [AU] Australia ..... 30383/92

[51] Int. Cl.[5] ..... E01B 29/00

[52] U.S. Cl. ..... 104/6

[58] Field of Search ..... 104/2, 5, 9, 6, 162, 104/163; 198/459, 610

[56] References Cited

U.S. PATENT DOCUMENTS

| | | | |
|---|---|---|---|
| 851,982 | 4/1907 | Downey | 104/6 |
| 1,097,006 | 5/1914 | Darden | 104/6 |
| 1,506,953 | 9/1924 | Stubbs | 104/6 |
| 1,566,570 | 12/1925 | App | 104/5 |
| 3,701,320 | 10/1972 | Fearon et al. | 104/6 |
| 4,080,903 | 3/1978 | Cicin-Sain | 104/6 |
| 4,094,249 | 6/1978 | Theurer et al. | 104/6 |
| 4,207,820 | 6/1980 | Cicin-Sain | 104/6 |
| 4,258,626 | 3/1981 | Theurer et al. | 104/6 |
| 4,924,042 | 5/1990 | Valditerra | 104/2 |

*Primary Examiner*—Mark T. Le
*Attorney, Agent, or Firm*—James Ray & Associates

[57] ABSTRACT

A sleeper laying apparatus comprises a mobile chassis having a front portion in the nature of a full trailer furnished with unsprung road wheels (11) permitting it to travel along a bare rail bed. A dual chain storage conveyor (15,16,17,18,19) extends along the front portion of the chassis with supported top chain flights on which a file of sleepers (21A) may rest and be fed, when the storage conveyor is operated, towards the rear of the chassis. The chassis further comprises a trailing rear portion supporting an inclined gravity conveyor (26,27) able to receive sleepers (21A) from the storage conveyor and allow them to gravitate onto the track bed, and a hold back escapement mechanism (32,33,34,35,36,37) disposed above said gravity conveyor in the nature of a dual chain conveyor with abutment arms (37) projecting from its chains (36) into the path of sleepers (21C) on the gravity conveyor to control the movement of sleepers thereon. Intermittent, synchronized operation of the storage conveyor and escapement mechanism is effected by controllers, responsive to the forward travel of the chassis, so as to release sleepers from the gravity conveyor onto the track bed at predetermined intervals. The controllers include a center wheel (40) rolling on the track bed and a signal generator responsive to rotation of the wheel generating signals initiating each operation.

8 Claims, 4 Drawing Sheets

SLEEPER LAYING APPARATUS

BACKGROUND OF THE INVENTION

1. Field of the Invention

This invention relates to the construction of railway track, and in particular to the emplacement of sleepers on the track bed prior to the affixture of rails to the sleepers.

2. Description of the Prior Art

Traditionally, sleepers have been manhandled into place during the construction of new railway track. This is laborious, slow and, therefore, expensive. Furthermore the accuracy of placement depends entirely on the care taken by the persons doing the laying, and, having regard to the difficulty of manually shifting a sleeper, it is not surprising that in many cases the end result leaves something to be desired.

Attempts to improve on purely manual methods include manually attaching a plurality (say six) sleepers to a jig adapted to hold them in a correctly spaced and aligned array, and then depositing the array as a unit by means of a mobile crane or the like. This method is still labour intensive and still requires care in the positioning of each array. Furthermore, it suffers from the fact that each individual array is straight and therefore not appropriate for curved sections of track. Nevertheless, this technique is still widely used.

In view of the deficiencies of the largely manual methods referred to above, track laying machines have been developed, that are intended to more or less fully automate the process of laying sleepers. Such prior known machines are large and complex items. They usually advance on the track they lay, and therefore run on track wheels and are not independently steerable. Thus they cannot travel by road and have to be partially dismantled for road transport between one operation and another. They are costly to make and constitute considerable idle capital if not fully occupied.

Those prior known machines have usually included devices for depositing the individual sleepers which lift the sleeper into place while it is resting on carry arms or held by clamping devices that then have to be retracted from underneath the sleeper. This has usually required a specially prepared grooved bed to be formed, so as to provide clearance for the carry arms, and subsequently rectified. This has added to the complexity of the process and has limited the use of known machines to operations in which the track bottom ballast has been trucked to site and pre-deposited; whereas it is more economic to deliver all the ballast by train travelling slowly on the unballasted track.

All in all, prior known sleeper laying machines cannot be justified on a cost basis, except, maybe, for very large track construction jobs.

SUMMARY OF THE INVENTION

Therefore an object of the present invention is to provide sleeper laying apparatus that is less complex and costly than prior known track laying machines.

A further object of the invention is to provide sleeper laying apparatus that may deposit sleepers on a bare track bed, that is to say one devoid of bottom ballast, and that may be driven or towed by road from one site to another.

The invention meets those objects by providing an apparatus that travels on road wheels and drops or discharges each sleeper directly onto the rail track bed in its intended position.

Therefore the invention consists in sleeper laying apparatus comprising a mobile chassis furnished with road wheels permitting it to travel along a bare rail bed, a storage conveyor on said chassis adapted to hold a file of sleepers and feed those sleepers towards the rear of the chassis, an inclined gravity conveyor at the rear of the chassis able to receive sleepers from said storage conveyor and allow them to gravitate onto the track bed, a hold back escapement means disposed above said gravity conveyor to control the movement of sleepers thereon, and control means, responsive to the forward travel of the chassis, controlling the actuation of said escapement means, whereby sleepers are discharged from said gravity conveyor at predetermined intervals of chassis movement.

For preference the mobile chassis is in the nature of a road trailer able to be towed by a prime mover, but in other instances it may be in the nature of a semi-trailer supported at one end by the prime mover, or it may be in the nature of a self propelled, non-articulated vehicle.

BRIEF DESCRIPTION OF THE DRAWINGS

By way of example, an embodiment of the above described invention is described in more detail hereinafter with reference to the accompanying drawings.

DESCRIPTION OF THE PREFERRED EMBODIMENT

Figure 1:
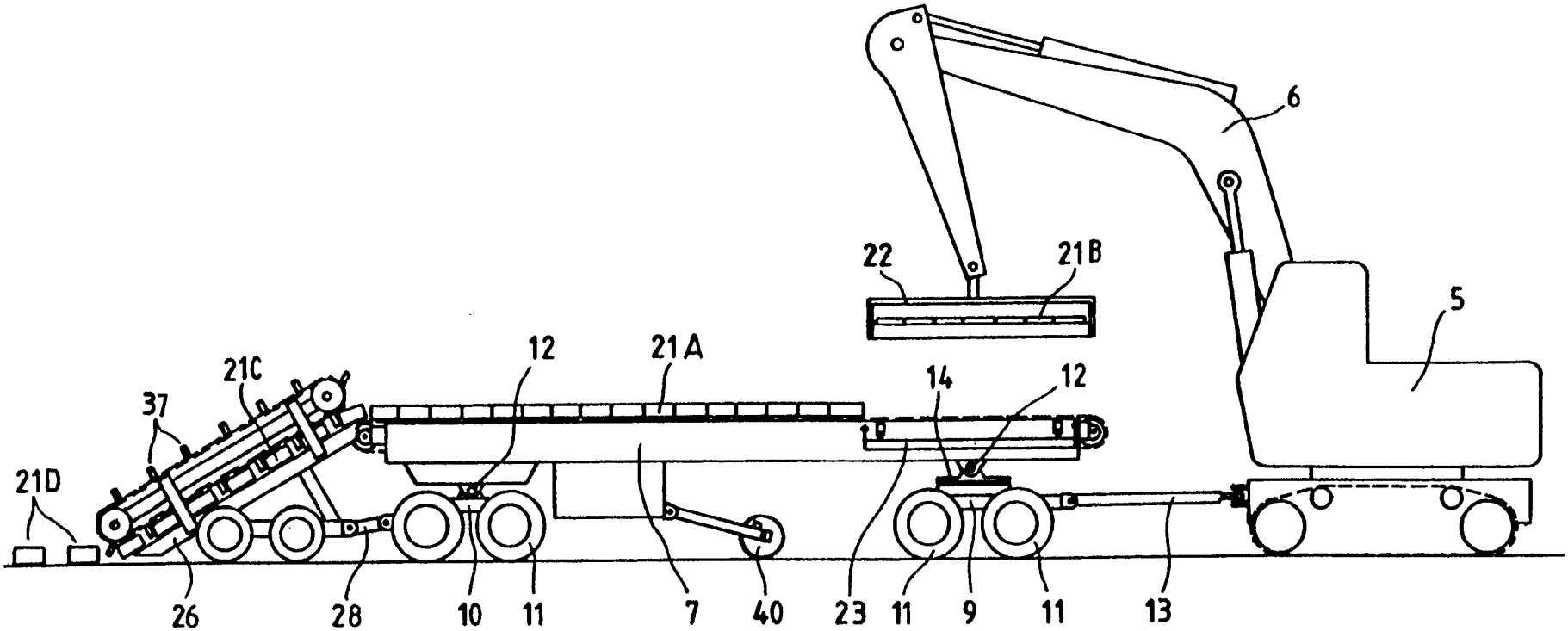
FIG. 1 is a diagrammatic side elevation of a sleeper laying apparatus according to the invention.

The illustrated embodiment is adapted to be towed, as a full trailer, by a conventional tractor vehicle 5 furnished with a conventional hydraulic crane 6, along a bare rail bed. The vehicle 5 normally travels in reverse when the apparatus is in use, so that the driver may readily observe the operation and tracking of the apparatus being towed. That apparatus comprises a mobile chassis comprising a load carrying frame, itself comprising main longitudinal members 7 and cross-braces 8, front and rear, dual axle, wheel bogies 9 and 10 respectively, and pneumatic tyred ground wheels 11.

The chassis is generally similar to the chassis of a conventional road freight trailer, and calls for no further detailed description herein. It differs primarily from such a road freight trailer in that it is unsprung, the wheel axles being mounted directly onto the wheel bogies, so that, in use, the chassis frame remains at a predetermined, substantially fixed height above the track bed.

The bogies 9 and 10 are pivotally connected to the chassis frame by pivots 12 intermediate the wheel axles so that the effect on the chassis frame of a wheel 11 riding over an inequality in the surface of the track bed is reduced.

The front bogie 9 is furnished with a towing hitch 13 and supports the chassis frame by way of a turntable 14. Thus the front of the chassis is steerable, to enable the apparatus as a whole to track correctly behind the tractor vehicle 5.

The chassis carries a storage conveyor comprising a head shaft 15 with head sprockets 16, a tail shaft 17 with tail sprockets 18, endless pin and link chains 19 riding about the respective pairs of sprockets, and a geared hydraulic motor unit 20 connected to the head shaft 15 for rotation thereof.

The top flights of the chains 19 slide upon the top faces of the chassis members 7. Thus they are adapted to support a file of sleepers 21A, and to advance them towards the rear when the motor unit 20 is driving. For preference the top flights of the chains 19 run between ribs or upward projections on the members 7 to prevent lateral deflection of the flights.

Sleepers 21B may be added to the front end of the file from time to time, by means of the crane 6 and a grab 22 adapted to grip a group of sleepers 21B by their respective opposite ends. Those sleepers 21B may be taken from a supply vehicle following the laying operation, or from stockpiles previously deposited alongside the track bed.

Figure 4:
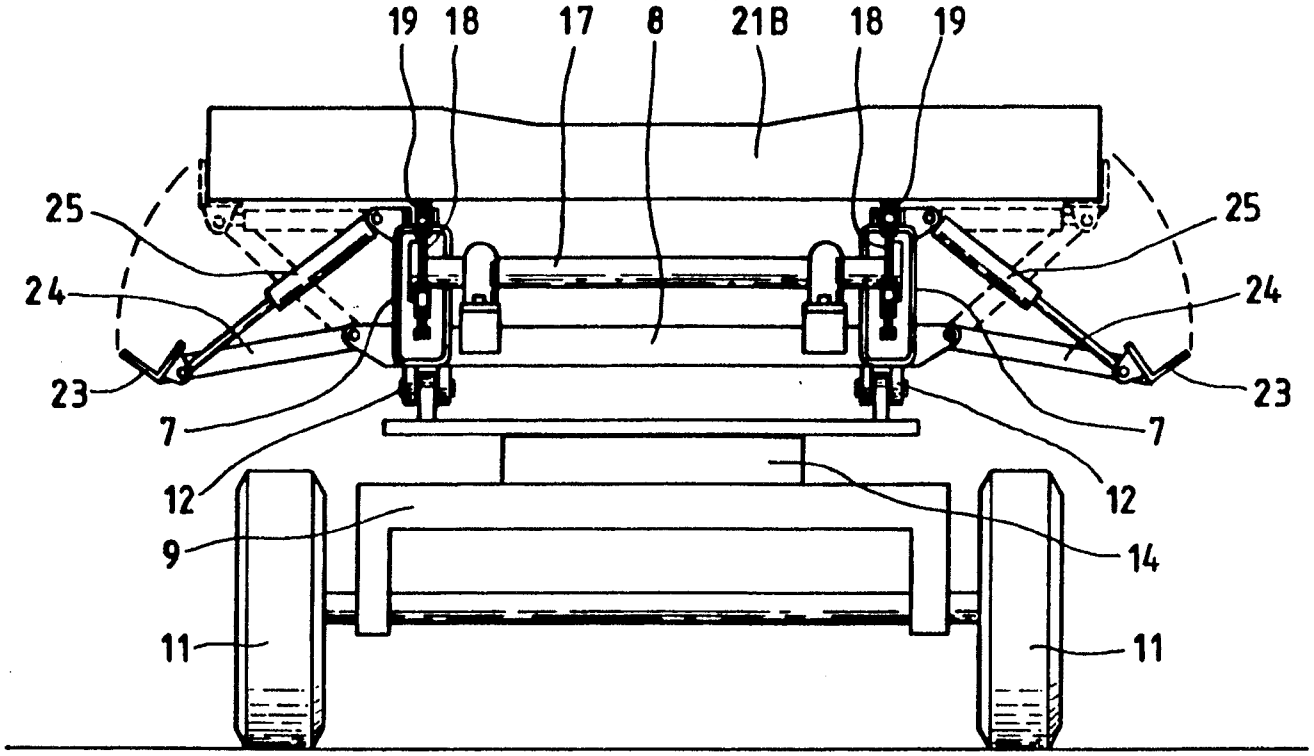
FIG. 4 is a diagrammatic front elevation of the apparatus of FIG. 1, drawn to a larger scale.

Having been deposited on the chains 19, the sleepers 21B are aligned with the sleepers 21A in the file thereof by means of rails 23 able to be swung upwardly with radius arms 24, upon contraction of hydraulic cylinder type thrustors 25 extending between pivotal anchorages on the radius arms 24 and the chassis members 7 respectively (as shown in broken outline in FIG. 4).

The apparatus chassis further comprises a trailing rear portion comprising downwardly and rearwardly inclined main members 26 supported by a dual axle bogie 27 connected rigidly to the members 26. The bogie 27 is connected to the main part of the chassis by a pair of laterally spaced apart towing links 28 interconnecting the bogies 10 and 27. The arrangement is such that the bogie 27 may rise and fall to accommodate minor inequalities in the track bed, but is otherwise constrained to follow directly behind the leading part of the chassis.

The members 27 may function as skids to receive sleepers 21C discharged from the storage conveyor, in which event they constitute the whole of the gravity conveyor of this embodiment of the invention. However, for preference, each member 27 comprises two spaced apart webs supporting a row of conveyor rollers 29 along which the sleepers 21C may gravitate.

The movement of the sleepers 21C down to the track bed is impeded and controlled by hold back escapement means supported above the gravity conveyor by a rigid frame 30. In this instance those escapement means comprise longitudinal members 31 supporting head and tail shafts 32 and 33 respectively, head and tail sprockets 34 and 35 respectively, endless chains 36 riding around the respective pairs of sprockets, abutment arms 37 projecting rigidly from links of the chains 36, a hydraulic geared motor unit 38 connected to the head shaft 28 and a pneumatic brake 39 acting on the shaft 28.

The abutment arms 37 extend into the path of the sleepers 21C and, when the motor unit 38 is not driving and the brake 39 is applied, prevent the sleepers 21C from descending. The motor unit 38 is nominally able to hold the escapement chains against movement when fluid flow to the motor is cut off, but the brake 29 is preferably present to prevent so called "hydraulic creep" due to fluid leakage if the apparatus is halted for a lengthy period with sleepers 21C on the gravity conveyor, for example overnight or between shifts.

Figure 2:
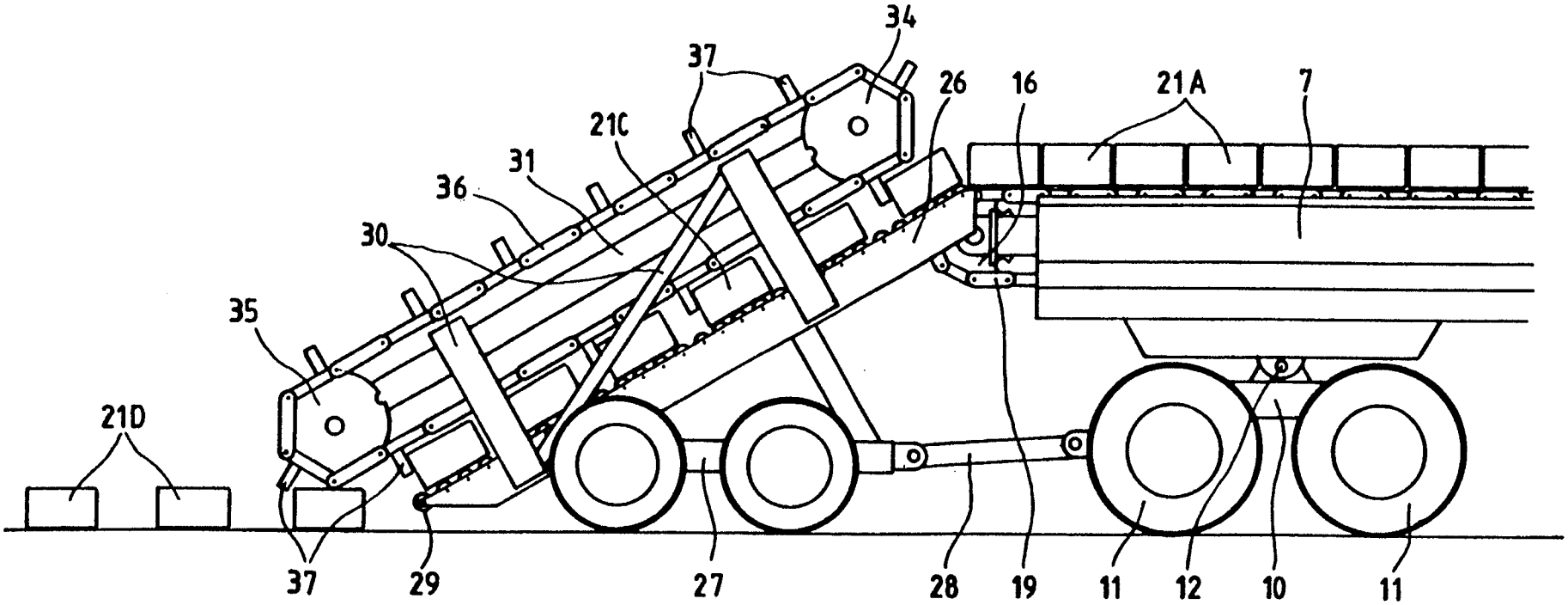
FIG. 2 is a diagrammatic side elevation of a rear part of the apparatus of FIG. 1, drawn to a larger scale.
Figure 3:
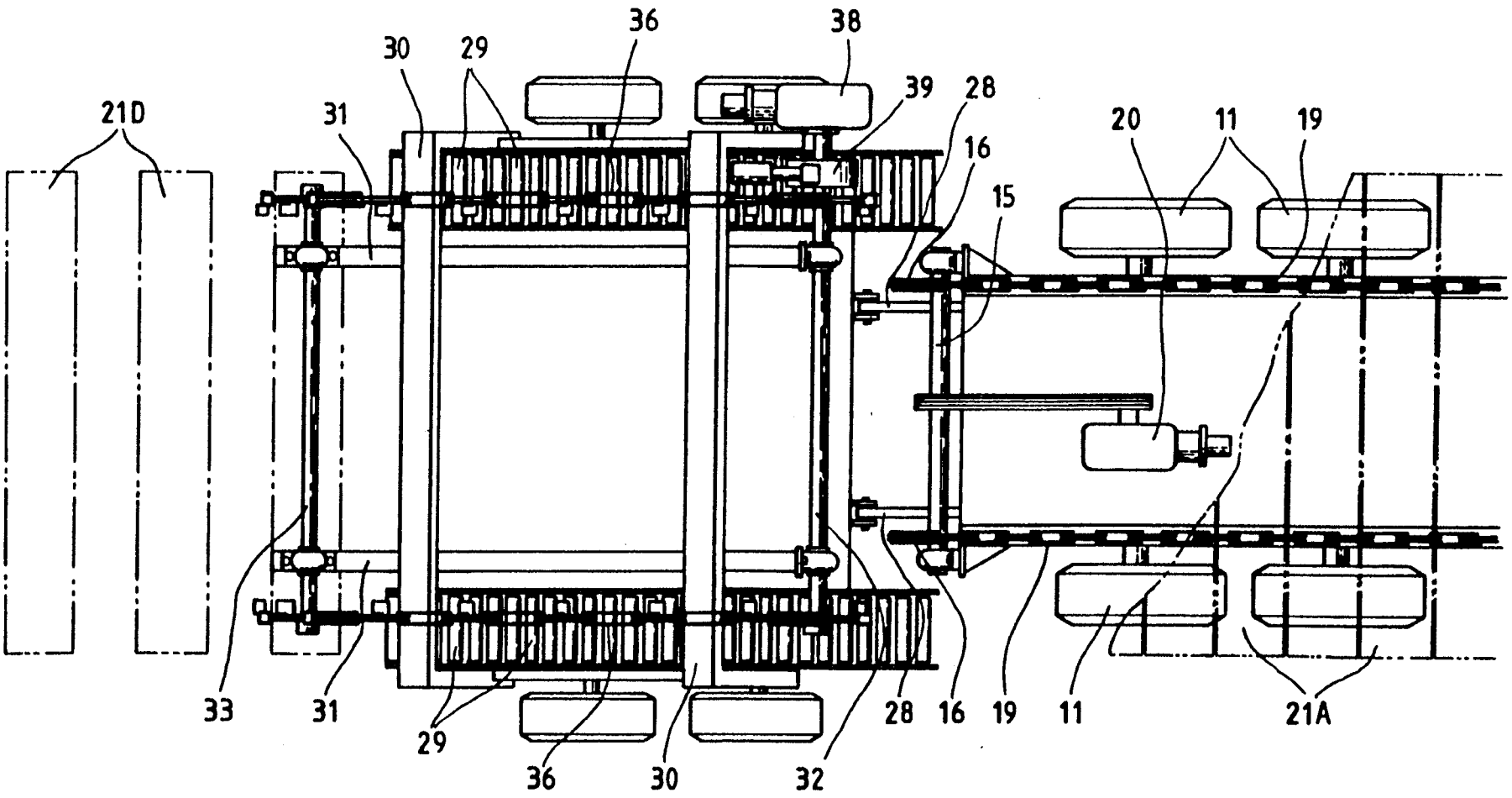
FIG. 3 is a diagrammatic plan view of the subject matter of FIG. 2.

The escapement means operate intermittently and at each operation the brake 39 is released and the motor unit 38 powered up long enough for the chains 36 to be moved from the stationary position shown in FIG. 2 by a distance equal to the pitch distance (spacing centre to centre) of the abutment arms 37. The direction of movement is downwards for the lower flights of the chains 36, and it will be apparent to the skilled addressee that this movement will result in the lowest sleeper 21C being deposited directly onto the track bed, to become one of the layed out sleepers 21D.

The storage conveyor also operates intermittently. Its movements are synchronised with those of the escapement means, so that each time a sleeper 21C is deposited, a replacement sleeper is fed onto the top end of the gravity conveyor by the storage conveyor.

The escapement means and storage are caused to perform an depositing operation each time the apparatus as a whole has travelled a distance along the rail track bed by a distance equal to the required pitch distance of the sleepers 21D.

Control means for the conveyor and escapement means, or more precisely for controlling the operations of the motor units 20 and 38 and the brake 39 are provided. Those means comprise a sensor responsive to the distance travelled by the apparatus. In this instance that sensor comprises a swing mounted, freely rotatable disc wheel 40 having a periphery equal to the required pitch distance of the deposited sleepers, or an integral number thereof. The wheel disc has an opening, or that integral number of equiangularly spaced openings, in its disc, and its swing mounting means carry an infra-red sender on one side of the wheel and an infra-red receiver on the other side. Each time the, or a, disc opening comes into alignment with the sender and receiver, the latter sends a signal to the rest of the control means.

The wheel 40 is preferably disposed on the centre-line of the chassis so that it measures rolls along the centre-line of the finished rail track. This is because the length of a track is traditionally measured along that line, and automatically ensures a correct nominal spacing of the sleepers on curved sections of the track; where the radially inner ends of the sleepers will be spaced at less than the nominal spacing and the outer ends at more than the nominal spacing.

The rest of the control means may comprise a relay that is sensitive to the signal from the sensor, controlling electrically operated hydraulic and pneumatic valves controlling supplies to the motor units and brake. Those control means may further comprise strategically placed limit switches actuated by the moving storage conveyor and escapement means, or sleepers moving therewith, to stop the motor units, apply the brake and reset the control relay at the end of each intermittent operation.

It will be apparent to the skilled addressee that the above described sensor could be replaced by other sensors responsive to distance moved, (including, for example a computer with an internal clock fed with data representing the towing vehicle's speed) but for preference a sensor making direct contact with the track bed is preferred for the sake of simplicity and accuracy.

That accuracy depends lack of slip between the wheel and the track bed, and on the absence of substantial errors due to minor irregularities in the track bed causing the wheel to rise and fall, and thus follow a path that longer than a perfectly level path. Such errors are reduced if the wheel has a relatively large diameter. Furthermore, if desired the single wheel may be replaced by two or more wheel in single file that are connected together by a gear train or caterpillar track or other means forcing them to rotate at the same speed, so as to average out such errors over the number of wheels contacting the bed at different places.

Also, if desired, the termination of each intermittent operation could be determined by the distance sensor responding to a distance appreciably shorter than the sleeper pitch distance, or by a timer, rather than by limit switches. In short the control means may take any form consistent with effecting synchronised operation of the various components at predetermined travel intervals of the apparatus.

I claim:

1. A sleeper laying apparatus comprising a mobile chassis furnished with road wheels permitting it to travel along a bare rail bed, a storage conveyor on said chassis adapted to hold a file of sleepers and feed those sleepers towards the rear of the chassis, an inclined gravity conveyor at the rear of the chassis able to receive sleepers from said storage conveyor and allow them to gravitate onto the track bed, a hold back escapement means disposed above said gravity conveyor to control the movement of sleepers thereon, and control means, responsive to the forward movement of the chassis, controlling the actuation of said escapement means, whereby sleepers are discharged from said gravity conveyor at predetermined intervals of chassis movement, wherein the escapement means comprises at least two laterally spaced head sprockets, at least to laterally spaces tail sprockets in respective alignment with the head sprockets, at least two endless chains trained around respective pairs of said head and tail sprockets and having lower flights above and substantially parallel to said gravity conveyor with equally spaced apart abutment arms projecting from said chains extending from the lower flights into the path of the sleepers on the gravity conveyor, and a motor unit controlling rotation of said head sprockets.

2. A sleeper laying apparatus according to claim 1 further comprising means to align sleepers deposited on said storage conveyor to form a straight file thereon.

3. A sleeper laying apparatus according to claim 1 wherein said storage conveyor is a chain conveyor comprising at least two laterally spaced endless chains having supported upper flights defining a flat support surface for said file of sleepers.

4. A sleeper laying apparatus according to claim 1 wherein said gravity conveyor and escapement means are carried on a rear portion of said chassis connected as a trailer to a front portion on which the storage conveyor is mounted.

5. A sleeper laying apparatus according to claim 1 wherein said gravity conveyor is a roller conveyor.

6. A sleeper laying apparatus according to claim 1 wherein said escapement means further comprise a brake to prevent rotation of said head sprockets.

7. A sleeper laying apparatus according to any one of the preceding claims wherein said control means comprise a sensor responsive to forward travel of said chassis comprising a freely rotatable wheel in rolling contact with the track bed, and signal generator means responsive to rotation of said wheel, whereby a control signal is generated at the termination of each said interval of chassis movement.

8. A sleeper laying apparatus according to claim 7 wherein said control means further comprise means responsive to each signal from said signal generator means to effect a limited operation of said escapement means to permit one sleeper to be discharged from said gravity conveyor and a limited operation of said storage conveyor to feed one further sleeper from said file onto said gravity conveyor.

* * * * *